US005326407A

United States Patent [19]

Baviere et al.

[11] Patent Number: 5,326,407

[45] Date of Patent: Jul. 5, 1994

[54] PROCESS FOR WASHING SOLID PARTICLES COMPRISING A SOPHOROSIDE SOLUTION

[75] Inventors: Marc Baviere, Noisy le Roi; Didier Degouy, Houilles; Jacqueline Lecourtier, Rueil Malmaison, all of France

[73] Assignee: Institut Francais du Petrole, Rueil Malmaison Cedex, France

[21] Appl. No.: 37,382

[22] Filed: Mar. 26, 1993

[30] Foreign Application Priority Data

Mar. 26, 1992 [FR] France ..... 92/03787

[51] Int. Cl.[5] ..... B08B 3/04; B08B 7/00

[52] U.S. Cl. ..... 134/25.1; 134/40; 134/33; 134/10; 252/174.17

[58] Field of Search ..... 134/40, 33, 10, 25.1; 252/174.17

[56] References Cited

U.S. PATENT DOCUMENTS

| | | | |
|---|---|---|---|
| 3,205,150 | 9/1965 | Spencer et al. | 435/146 |
| 3,622,344 | 11/1971 | Allingham | 426/557 |
| 4,216,311 | 8/1980 | Inoue et al. | 536/115 |
| 4,297,340 | 10/1981 | Abe et al. | 424/70 |
| 4,305,961 | 12/1981 | Tsutsumi et al. | 424/361 |
| 4,645,608 | 2/1987 | Rayborn | 134/40 |
| 4,836,302 | 6/1989 | Heilhecker et al. | 134/40 |

FOREIGN PATENT DOCUMENTS

| | | |
|---|---|---|
| 0084411 | 7/1983 | European Pat. Off. . |
| 0330379 | 8/1989 | European Pat. Off. . |

*Primary Examiner*—R. Bruce Breneman
*Assistant Examiner*—Zeinab El-Arini
*Attorney, Agent, or Firm*—Antonelli, Terry, Stout & Kraus

[57] ABSTRACT

The invention relates to a process for cleansing solid particles impregnated with hydrocarbons. The process implements a solution comprising sophorosides. The process is particularly intended for washing cuttings impregnated with a drilling fluid containing hydrocarbons.

12 Claims, No Drawings

PROCESS FOR WASHING SOLID PARTICLES COMPRISING A SOPHOROSIDE SOLUTION

BACKGROUND OF THE INVENTION

The present invention relates to a process utilizing a solution containing sophorosides, said process being adapted for cleansing hydrocarbon-impregnated solid particles. This process is more particularly intended for washing oil well cuttings.

In the field of oil drilling, the cuttings pulled out by the tool are taken up to the surface by the upflow of the drilling fluid injected through the channel of the drill string. Drilling fluids containing hydrocarbons are very commonly used to solve drilling problems in formations reactive in the presence of water, for example some clays or salt. The drilling fluids suited to high temperatures may also be based on mineral oil. Particularly, in the North Sea, about 75% of the wells are drilled with oil-based fluids. In these cases, the cuttings coming up to the surface are impregnated with a relatively large amount of hydrocarbons.

Discharge of these impregnated cuttings is generally regulated by the local authorities.

More particularly, in offshore drilling operations, discharge of such cuttings is no longer allowed until they have been subjected to an additional treatment to conform to current standards. The operator thus has to face the following choices:

- not to use drilling fluids containing hydrocarbons any longer,
- to transport the polluted cuttings on shore to subject them to a specific treatment before discharge,
- to cleanse the cuttings so as to be able to discharge them at sea.

The first two choices may not be viable for technical and/or economic reasons. It would thus be advantageous to use the third technique while having an efficient and economical means for washing the cuttings on site.

Document EP-A-0,330,379 notably describes an aqueous solution intended for cleansing oil-impregnated surfaces, for example drill cuttings.

But this document does not recommend the use of sophorosides.

Documents U.S. Pat. No 4,645,608 and EP-A-0,084,411 also describe methods for washing cuttings and recommending formulations containing mainly solvents and surface active agents or surfactants. None of these two documents envisages using sophorosides.

SUMMARY OF THE INVENTION

The present invention relates to a process for cleansing solid particles impregnated with a polluting fluid comprising hydrocarbons. This process consists in bringing together said solids and a washing solution comprising sophorosides.

In this process, said solids may be drill cuttings.

The solution may comprise sophorosides at a concentration ranging between 0.1 and 30 g/liter.

The washing solution may comprise at least one other compound adapted for one of the following functions: adjusting the pH value of the solution, solubilizing the hydrocarbons, inhibiting the swelling and/or the dispersion of the solid particles.

According to this process, the cleansed solids may be separated from said washing solution through at least one of the following means: decanting, sifting, centrifuging, filtering or cycloning.

Said washing solution may be separated from said polluting fluid by decanting and/or by centrifuging.

Using sophorosides may now be considered since the patent application FR-90/16,211 filed by the applicant discloses a particularly advantageous process for manufacturing sophorosides. In fact, before this process was known, it was notably difficult and very costly to manufacture this product on an industrial scale. Now, this family of products, well-known for being used in cosmetology or in the farm-produce industry, reveals interesting properties, notably for washing drill cuttings.

Sophorosides are currently known for the following two main applications:

- bactericidal agents when the product appears in the lactone form,
- emulsifying agents in the farm-produce industry (U.S. Pat. No. 3,622,344) and hydrating agents in the cosmetic industry (U.S. Pat. No. 4,305,961). In these applications, the product appears in the ester form.

The definition of these two lactone and ester forms of sophorosides is specified hereafter.

This family of products notably has the following advantages:

- the diversity of the possible sophoroside structures provides a high flexibility of use and makes them easily adaptable to a specific application. This is explained hereafter in the description of the sophorosides;
- sophoroside compounds are not toxic. Moreover, their innocuousness allows their use in the farm-produce industry and in cosmetology;
- they are entirely biodegradable;
- they are stable notably in alkaline medium, unlike sugar esters. Drilling fluids are generally alkaline;
- the fermentation manufacturing process disclosed by application FR-90/16,211 enables good efficiency rates to be obtained;
- the raw materials, sugars and fatty bodies, are little costly and easily available.

Sophorosides have been described since 1961 notably by Gorin et al. in Can. J. Chem., 39, 846–55 (1961), Amser et al. in J. American oil Chem. Soc., 65(9), 1460–6 (September 1988) and by Spencer et al. (U.S. Pat. No. 3,205,150).

They are extracellular compounds produced during a fermentation process using a yeast such as *Candida bombicola*.

Sophorosides are glycosides resulting from the association of a sugar, sophorose, formed by the yeast from two glucose molecules, and of a fatty hydroxyacid also formed by the yeast from substrates such as hydrocarbons, saturated or unsaturated fatty acids, fatty acid esters including glycerids, and vegetable oils: colza, sunflower, palm or soybean oils, methylic or ethylic esters of these oils. The hydroxylation of fatty acid is performed in $\omega$ position or most often in $\omega$-1 with respect to the carboxylic acid function.

Sophorosides are considered as a mixture of compounds whose structures may be represented by the formulas (1) and (2) hereafter:

Formula (1)

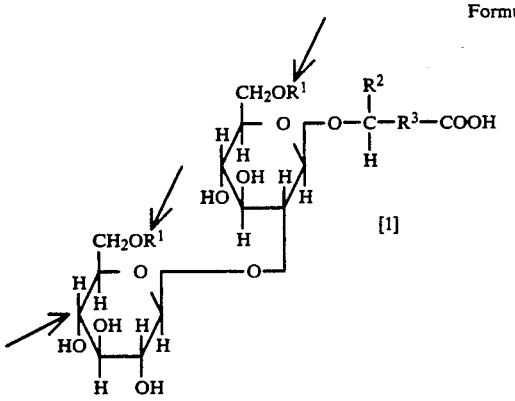

[1]

Formula (2)

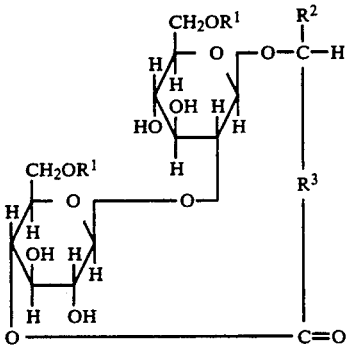

[2]

In formulas (1) and (2), R1 stands for hydrogen or an acetyl group (CH3CO—), R2 stands for hydrogen or an alkyl group comprising 1 to 9 carbon atoms when R3 is a saturated hydrocarbon radical comprising 7 to 16 carbon atoms, or R2 stands for hydrogen or a methyl group when R3 is an unsaturated hydrocarbon radical comprising 13 to 17 carbon atoms.

The cyclization of the fatty acid form (formula (1)) to give the lactone form (formula (2)) may be performed as shown in formula (2) or on other sites of the sophorose radical, for example those shown by the arrows.

Sophorosides thus consist of a mixture of many compounds, notably isomers and homologs. The composition of this mixture depends on the nature of the substrate and on the fermentation conditions. Document FR-2,399,438 cited in application FR-90/16,211 may be consulted.

Sophorosides may be used as amphiphilic agents through the presence, in the molecule, of a hydrophilic part formed by the sophorose group and of a lipophilic part constituted by the fatty acid. The amphiphilic nature is established notably by the surface-active properties, for example, fall in the surface tension of water (Abe et al., U.S. Pat. No. 4,297,340) or in the water-hydrocarbon interfacial tension (Gutnick and Minas, Biochem. Soc. Trans., 22S-35S (1987)), by the emulsifying or the demulsifying properties (Cooper and Paddock, Applied and Environmental Microbiology, 47(1), 173-6 (1984)), by the wetting properties, etc.

The properties of the direct fermentation product may be adjusted as a function of the desired result or application. In fact, a judicious choice of the substrate, that is, more precisely, of the structure and of the molecular mass of the hydrocarbons, the fatty acids or the fatty acid esters used in the fermentation manufacturing process, allows, to some extent, the HLB of the product to be adjusted. The concept of HLB, or Hydrophile-Lipophile Balance, has been described by Griffin in J. Soc. Cosmetic Chemists, 1, 311-24 (1949). Thus, for example, with a HLB value lower than about 8, the product obtained will tend to form preferably water-in-oil type emulsions. Beyond this value, the emulsions formed will preferably be of the oil-in-water type.

Furthermore, the direct fermentation product may be subjected later to chemical modifications enabling the structure and thus the properties of the majority compounds to be better adapted to the application requirements.

The chemical modifications of the direct fermentation product may notably consist in:

partial or total deacetylation of the sophorose group, partial or total delactonization. Delactonization consists in the opening of the lactone cycles (formula (2)), which liberates the carboxylic acid group, esterification of the carboxylic acid group through alcohols whose structure and molecular mass also constitute parameters for adjusting the properties. For example, according to patent U.S. Pat. No. 4,297,340, the HLB value ranges from 6 (lipophilic surfactant) to more than 20 (very hydrophilic surfactant) when the alcohol used for the esterification has a number of carbon atoms passing from 18 (stearylic alcohol) to 1 (methyl alcohol).

It should be noted that sophorosides are, at the same time, entirely biodegradable and non toxic, unlike the surfactants generally used in the technical field of the present invention, be they ionic, for example alkylaryl sulfonates, or non ionic, for example polyethoxyl derivatives. These characteristics are very advantageous with respect to ecological problems.

DESCRIPTION OF THE PREFERRED EMBODIMENTS

Other features and advantages of the invention will be clear from reading the description hereafter of non limitative experiments.

Determination of the capacity of sophoroside solutions for washing drill cuttings polluted by hydrocarbons is achieved under the test conditions described hereafter.

The washing tests have been carried out in the laboratory, at 30° C., with two types of cuttings:

a) model cuttings consisting of a clay (Bentonite Clarsol W 100 supplied by the Milpark Drilling Fluid Co.) impregnated with a conventional mineral oil, such as those used in the formulation of oil-based drilling fluids, b) natural cuttings stemming from drilling with an oil-based mud.

The sophoroside used is the direct fermentation product, named SO 1, and has been subjected to no later chemical modification. It contains 46% by weight of sophoroside in the acid form (formula (1)) and 54% by weight of sophoroside in the lactone form (formula (2)).

By way of comparison, the following non ionic surfactants have also been tested:

an ethoxyl alcohol or product A, ethoxyl nonylphenols or products B, having HLB values ranging between 8.8 and 16.5.

The tests have been carried out according to the following operating procedure:

1 gram of cuttings, impregnated with oil, is washed with 20 ml of an aqueous solution of washing products comprising either sophorosides or said non ionic surfactants: products A or B. The water used is reconstituted sea water, akin to the water of the North Sea, whose composition is given hereunder:

| Ions | $Na^+$ | $K^+$ | $Ca^{++}$ | $Mg^{++}$ | $Cl^-$ | $S04^{--}$ | Total |
|---|---|---|---|---|---|---|---|
| Concent. (g/l) | 11.0 | 0.68 | 0.33 | 1.19 | 19.6 | 2.80 | 35.6 |

The cuttings and the solution are mixed together by stirring for 15 minutes by means of a bar magnet. The mixture is then centrifuged at 1500 rpm for 15 minutes, so as to separate the cutting from the washing solution. The cutting is then rinsed with 10 ml sea water. A second centrifuging process is then performed, in order to remove the rinsing water, and followed by a second rinsing. Finally, the mixture is filtered on a Millipore filter of 8-micrometer mesh aperture size.

The residual oil is proportioned on the cake obtained thereby through the Rock-Eval pyrolysis method (J Espitalié et al., Revue IFP, 40(5), 563-79 (September-October 1985)). This method consists in heating, through temperature programming, in an inert atmosphere, a small rock sample of about 100 mg, so as to determine the hydrocarbon content of this sample. These hydrocarbons are analyzed by means of a flame ionization detector.

Table 1 hereunder shows the results of the washing of the cuttings with a solution of sophoroside in sea water:

TABLE 1

WASHING WITH THE SOPHOROSIDE SOLUTION

| SO 1 Concent. | Model cuttings Residual oil | Efficiency | Natural cuttings Residual oil | Efficiency |
|---|---|---|---|---|
| (g/l) | (g/kg) | (%) | (g/kg) | (%) |
| 0 | 56 | 83 | 95 | 40 |
| 0.1 | 11 | 97 | | |
| 0.5 | 11 | 97 | | |
| 1.0 | 10 | 97 | 74 | 53 |
| 2.5 | 18 | 95 | 75 | 52 |
| 5.0 | 6.7 | 98 | 73 | 54 |
| 10 | 16 | 95 | 67 | 58 |
| 20 | 7.5 | 98 | | |

TABLE 2

WASHING OF MODEL CUTTINGS WITH PRODUCT A

| Washing fluid | Residual oil (g/kg) | Efficiency (%) |
|---|---|---|
| Sea water | 56 | 83 |
| Sea water and product A Conc.(g/l) | | |
| 0.01 | 34 | 90 |
| 0.02 | 27 | 92 |
| 0.05 | 23 | 93 |
| 0.5 | 9 | 97 |
| 1.00 | 11 | 97 |
| 2.50 | 23 | 93 |
| 5.00 | 20 | 94 |
| 10.0 | 71 | 79 |

TABLE 3

WASHING OF REAL CUTTINGS WITH PRODUCTS A AND B

| Washing fluid | Residual oil (g/kg) | Efficiency (%) |
|---|---|---|
| Sea water | 95 | 40 |
| Sea water and product A Conc.(g/l) | | |

TABLE 3-continued

WASHING OF REAL CUTTINGS WITH PRODUCTS A AND B

| Washing fluid | Residual oil (g/kg) | Efficiency (%) |
|---|---|---|
| 0.50 | 98 | 38 |
| 1.00 | 100 | 37 |
| Products B (HLB) Conc.: 1 g/l | | |
| B1 (8.8) | 74 | 53 |
| B2* (10.8) | 84 | 47 |
| B3 (12.2) | 114 | 28 |
| B4 (13.3) | 93 | 42 |
| B5 (16.5) | 87 | 45 |

*The concentration is 0.5 g/l.

In the case of model cuttings, the initial amount of oil measured is about 330 g/kg.

In the case of natural cuttings, the initial amount of oil measured is about 160 g/kg.

The efficiency is the ratio, expressed in percentage, between the amount of oil collected from the cuttings by washing and the initial amount of oil in the cuttings considered.

By way of comparison, and in order to assess the efficiency of the SO 1 solution, table 2 above gives the results of the washing of the model cuttings with reconstituted sea water, and a solution of product A in sea water for various concentrations of the product.

Table 3 above gives the results of the washing of real cuttings with sea water, with a solution of product A at two concentrations in sea water and with solutions of products B: B1-B2-B3-B4 and B5, having respectively the following HLB values: 8.8-10.8-12.2-13.3 and 16.5.

These test results show the capacity of an aqueous solution of sophoroside SO 1 for washing cuttings polluted by hydrocarbons. It may be noted that the efficiency of the SO 1 solution is good with respect to products conventionally used in the profession.

Furthermore, after washing, the speed of the separation, through simple decanting between the oil and the initial solution, of the solutions containing sophorosides is higher than that of the solutions containing the product A or B. This quality is very advantageous to obtain a good efficiency of the washing process and an optimum re-utilization of the washing fluid.

On account of what has been written above on the possibilities of optimizing the mixture and the structure of the sophorosides to obtain determined properties, using such solutions affords a high adaptability to pollution types and to the natures of the solids polluted.

The washing solutions containing sophorosides according to the invention may have formulations comprising other compounds, for example solvents, flocculents or even other surfactants.

In fact, addition, in the solution, of a solvent, for example of the cyclohexane or hexane type, or equivalents, will favour the cleansing of the cuttings:

- by decreasing the viscosity of the oil impregnating the solid particles and thereby facilitating the detergent action,
- by accelerating decantation of the oil during the stage of separation between the oil and the washing solution.

The solvent volume concentrations may range between 10 and 20% of the overall volume of the solution.

Addition, in the washing solution, of flocculents of the fine clayey particles is also recommended. In fact, cuttings of clayey nature do not disperse or disperse much in the oil-based drilling fluid. But, in contact with the aqueous washing solution, they generally tend to react and to swell. It is well-known that this swelling causes destabilization and dispersion of solid particles. This dispersion is unfavourable to cleansing since it increases the specific surface of said particles. The function of the flocculating products is therefore notably to prevent dispersion of the particles, which facilitates cleansing and, at the same time, separation of the solids from the liquid phase. These products may be, for example, polymers of the anionic or cationic polyacrylamide type, ethylene polyoxides, mineral salts or quaternary ammonium salts.

Implementation of the process according to the invention may notably comprise the following stages:

1) Separating the solid particles (cuttings) from the drilling fluid (polluting liquid phase) by decanting, sifting, centrifuging, cycloning or any other mechanical separation system. In drilling operations, this stage is performed by the unit of the drill rig intended for the mechanical treatments of the drilling fluids to extract the cuttings from these fluids.

2) Washing the solid phase extracted thereby through immersion in an appropriate volume of washing solution and mixing in a wash tank.

3) Separating, when the action time of the washing solution is reached, the washed solids from the washing solution by passage through a vibrating sieve.

The solid phase recovered may be discharged if it is clean enough, or subjected to a new washing process (second stage).

The liquid phase then consists notably of the washing solution, the polluting fluid and fine solid particles.

4) Removing the fine particles from this liquid phase, for example by centrifuging.

These particles may thereafter be discharged if they are clean enough or subjected to an additional filtration treatment, an industrial process that is well-known in the field of cuttings cleansing.

5) Decanting and/or centrifuging the liquid phase resulting from the previous operation in order to separate the polluting fluid from the washing solution The washing solution is thereafter recycled into the wash tank of stage 2. The polluting fluid is either stocked or recycled into the drilling fluid.

Without departing from the scope of this invention, the process may be applied to the cleansing of sands or of gravels polluted by hydrocarbons discharged either by flowing oil wells or by stock or transportation means. In fact, the efficiency of the process according to the invention is related neither to the size nor to the nature of the solid particles polluted by hydrocarbons.

We claim:

1. A process for cleansing solid particles impregnated with a polluting fluid comprising hydrocarbons, which comprises admixing said solid particles and a washing solution comprising sophorosides.

2. A process as claimed in claim 1, wherein said solid particles are drill cuttings.

3. A process as claimed in claims 1 or 2, wherein said solution comprises sophorosides at a concentration ranging between 0.1 and 30 g/liter.

4. A process as claimed in claim 1, wherein the washing solution comprises at least one other compound adapted for one of the following functions: adjusting the pH value of the solution, solubilizing the hydrocarbons, and inhibiting the swelling and/or the dispersion of the solid particles.

5. A process as claimed in claim 1, wherein the cleansed solid particles are separated from said washing solution through at least one of the following steps: decanting, sifting, centrifuging, filtering or cycloning.

6. A process as claimed in claim 5, wherein after separation of said solid particles, said washing solution is separated from said polluting fluid by decanting and/or centrifuging.

7. A process for cleansing solid particles impregnated with a polluting fluid comprising hydrocarbons which comprises washing said solid particles with a washing solution comprising sophorosides and water, and then separating the solid particles from said washing solution.

8. A process as claimed in claim 7, wherein said solid particles are drill cuttings from an oil well.

9. A process as claimed in claim 8, wherein said washing solution comprises the sophorosides in a concentration ranging between 0.1 and 30 g/liter.

10. A process as claimed in claim 7, wherein said water comprises sea water.

11. A process as claimed in claim 7, further comprising, after separation of said solid particles, separating the washing solution from said polluting fluid by at least one of the steps of decanting and centrifuging.

12. A process as claimed in claim 7, wherein said washing solution further comprises an organic solvent in a concentration ranging between 10 and 20% of the overall volume of the washing solution.

* * * * *